United States Patent [19]

Thow

[11] Patent Number: 5,026,579

[45] Date of Patent: Jun. 25, 1991

[54] COMPOSITE ARTIFICIAL LOG

[75] Inventor: Ian Thow, Merseyside, England

[73] Assignee: Yale and Valor p.l.c., Chiswick, England

[21] Appl. No.: 443,109

[22] Filed: Nov. 28, 1989

[51] Int. Cl.[5] ..... F24C 3/04

[52] U.S. Cl. ..... 428/15; 126/92 AC; 126/512; 428/18; 431/125

[58] Field of Search ..... 126/92 AC, 92 R, 512; 428/18, 15; 431/125

[56] References Cited

U.S. PATENT DOCUMENTS

| | | | |
|---|---|---|---|
| 3,231,401 | 1/1966 | Price et al. | 501/105 |
| 3,253,936 | 5/1966 | Weindel et al. | 501/124 |
| 3,362,395 | 1/1968 | Peterson | 126/512 |
| 3,377,229 | 4/1968 | Bryan | 428/18 |
| 3,871,355 | 3/1975 | Henry | 126/512 |
| 3,947,229 | 3/1976 | Richter | 126/92 R |
| 4,076,490 | 2/1978 | Hilker | 428/18 X |
| 4,573,905 | 3/1986 | Meyers | 126/512 X |
| 4,637,372 | 1/1987 | Mogol et al. | 126/512 |
| 4,664,620 | 5/1987 | Kendall et al. | 126/92 AG X |
| 4,838,240 | 6/1989 | Rieger | 428/18 X |
| 4,883,043 | 11/1989 | Thow et al. | 126/92 AC X |

*Primary Examiner*—Henry F. Epstein

*Attorney, Agent, or Firm*—Wood, Herron & Evans

[57] ABSTRACT

The present invention is directed to a composite artificial log for use in gas-fired artificial log fireplace assemblies or stoves, and more particularly, to a composite artificial log which has a ceramic concrete upper section molded to resemble a real log and having a relatively high thermal conductivity, which radiates a substantial amount of heat to the surroundings when heated, and a ceramic fiber lower section having a relatively low thermal conductivity, which glows visibly when heated above about 1470° F.

8 Claims, 2 Drawing Sheets

COMPOSITE ARTIFICIAL LOG

FIELD OF THE INVENTION

The present invention is directed to a composite artificial log for use in gas-fired artificial log fireplace assemblies or stoves, and more particularly, to a composite artificial log which has a ceramic concrete upper section molded to resemble a real log and which radiates a substantial amount of heat to the surroundings when heated, and a ceramic fiber lower section which glows visibly when heated above about 1470° F. (800° C.).

BACKGROUND

Fireplaces are very popular and desirable in houses and apartments, both for heating as well as for aesthetics. It is becoming more and more common to install gas-burning fireplaces as an alternative to solid fuel burning fireplaces, however, since the latter require manual refueling and clearing of ashes. Oftentimes, artificial logs are used in gas fireplaces and stoves to add an element of realism to the gas fire.

Known artificial logs are typically made of a refractory material which is impervious to very hot gas flames. U.S. Pat. No. 3,362,395 discloses a variety of refractory materials commonly used for artificial logs. These materials can be molded or manually shaped and decorated to resemble a natural log. While logs of this type may provide a visual resemblance to natural logs, they do not provide the visual effect of a burning log when used in a gas fireplace or stove assembly. What is needed is an artificial log which provides the visual appearance of a natural log, which radiates substantial heat to the surroundings when heated and which glows to provide the appearance of the burning embers of a natural log when heated in a gas fireplace or stove assembly.

SUMMARY OF THE INVENTION

The present invention is directed to a composite artificial log which has an upper section composed of ceramic concrete, which has a relatively high thermal conductivity and radiates substantial heat to the surroundings when heated, and a lower section composed of inorganic ceramic fiber material having a relatively low thermal conductivity which glows visibly when heated above about 1470° F. (800° C.). Both the upper and lower sections constitute a substantial fraction of the cross-section of the composite log.

The upper section of the composite log is preferably made of a material such as crushed firebrick, fire clay grog, or some other refractory material having a relatively high thermal conductivity above about 0.5 BTU/hr Ft° F. This upper section of the log can be molded or manually decorated to resemble a natural log and can withstand extremely high temperatures—on the order of 2300° F. Due to its relatively high thermal conductivity, the upper section radiates a substantial amount of heat to the surroundings when heated. The lower portion of the log, which is preferably made of a ceramic fiber of inorganic alumina silicate mixed with a suitable amorphous silica binder, has a relatively low thermal conductivity, about 0.09 BTU/hr Ft° F., and glows visibly when heated above about 1470° F. Since the upper and lower sections each constitute a substantial fraction of the cross-section of the composite log, the combined effect of the upper and lower sections of the composite log of the present invention is such that when the log is heated above about 1470° F., the upper section provides the aesthetics of a natural log and radiates substantial heat to the surroundings, while the lower section glows visibly, thereby providing an exceptionally realistic-looking artificial log fire.

The upper and lower sections of the composite log may be secured together in one of several preferred manners. In one embodiment, the upper and lower sections are secured together with any one of the generally known adhesives that are capable of withstanding the high temperatures. In another embodiment, mechanical fasteners are used to secure the two sections together. In a further embodiment, the upper and lower sections mate together with at least a portion of the lower section mating within a cavity in the upper section, to thereby secure the two sections together.

These and other features and advantages of the present invention will become more apparent with reference to the accompanying drawings and the detailed description thereof.

DETAILED DESCRIPTION OF THE INVENTION

Figure 1:
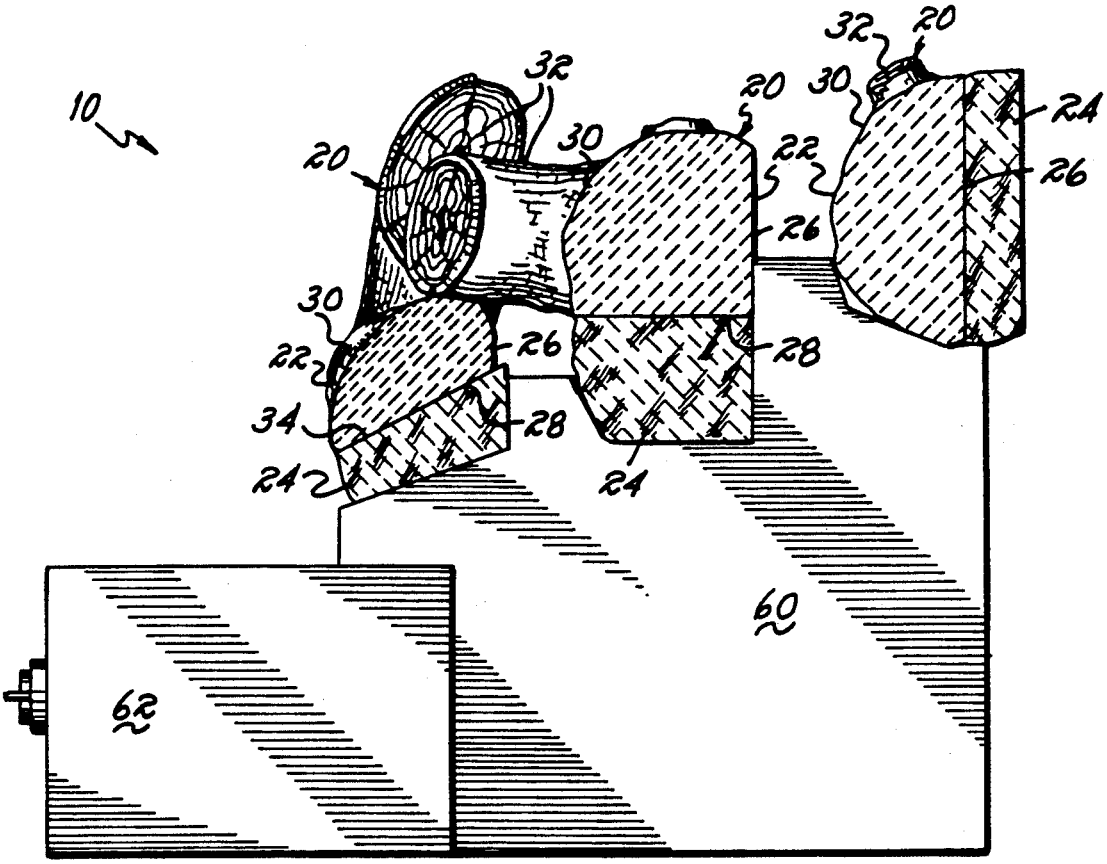
FIG. 1 is a side elevation, in partial cross-section, of an artificial log assembly, including two composite artificial logs of the present invention.

FIG. 1 shows an artificial log assembly 10 for use in a gas-fired fireplace or stove. Assembly 10 includes composite artificial logs 20 of one embodiment of the present invention, a support structure 60 for composite logs 20 and a gas control mechanism 62.

Figure 2:
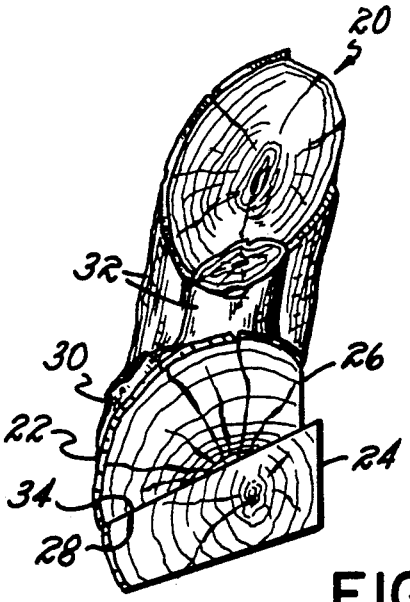
FIG. 2 is an end view of a composite log of the present invention.

FIG. 2 shows an end view of composite log 20, which has an upper section 22 and a lower section 24. In a preferred embodiment, upper section 22 of composite log 20 has substantially flat rear and bottom surfaces 26 and 28, respectively, and a convex front surface 30. In addition, upper section 22 may also include truncated limb segments 32 extending outwardly from front surface 30. Lower section 24 has at least a flat upper surface 34 that corresponds to flat bottom surface 28 of upper section 22. Upper section 22 and lower section 24 are secured together with their bottom and upper surfaces 28 and 34, respectively, in abutting relationship to form the composite log of the present invention.

Upper section 22 of composite log 20 is preferably molded or manually shaped of a ceramic concrete refractory material having the following composition: 15–25% high temperature cement, e.g., that sold by Fondu LaFarge under the trade name SECA R51, with the balance being volcanic aggregate. The material has a thermal conductivity above about 0.5, with the thermal conductivity of the preferred material being 0.5373 BTU/hr Ft° F., and therefore radiates a substantial amount of heat to the surrounding atmosphere when heated. Additionally, this material is easily molded or shaped to resemble a natural wood log with bark, knots and truncated limb segments, as desired.

Lower section 24 of composite log 20 is molded of a material having a thermal conductivity which is relatively low, preferably inorganic alumina silicate fibers in an amorphous silica binder material, which preferably has a thermal conductivity of 0.092 BTU/hr Ft° F. Although it should be appreciated that other ceramic fiber materials may be suitable. This lower section 24 glows visibly when heated above about 1470° F. Thus, when composite log 20 is heated above about 1470° F. by a gas flame, upper section 22 radiates substantial heat to the surroundings while lower section 24 glows visibly, thereby providing the visual effect of a burning log with glowing embers. Both the upper and lower sections, 22 and 24, constitute a substantial fraction of the cross-section of composite log 20.

Upper and lower sections 22 and 24 of composite log 20 are preferably secured together with an adhesive that can withstand the high temperature to which composite log 20 will be exposed. Suitable adhesives are generally known to persons of ordinary skill in the art and the particular adhesive is not a critical aspect of the present invention. In an alternative embodiment, not shown, the upper and lower sections of composite log 20 are secured together with a suitable mechanical fastening or securing means.

Figure 3:
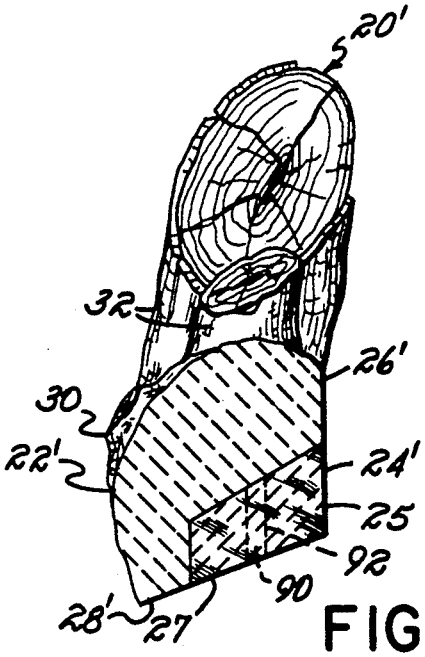
FIG. 3 is a cross-section of an alternative embodiment of the composite artificial log of the present invention.
Figure 4:
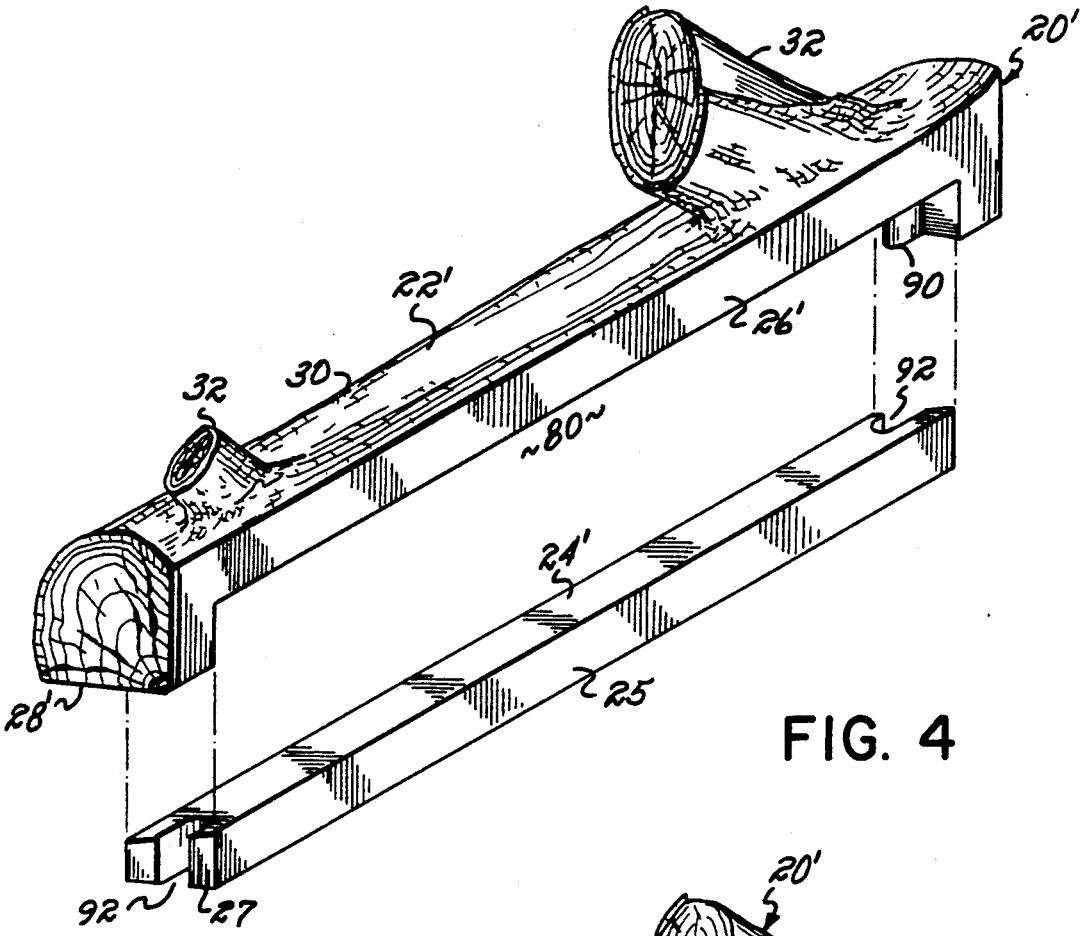
FIG. 4 is an exploded perspective view of the composite log shown in FIG. 3.
Figure 5:
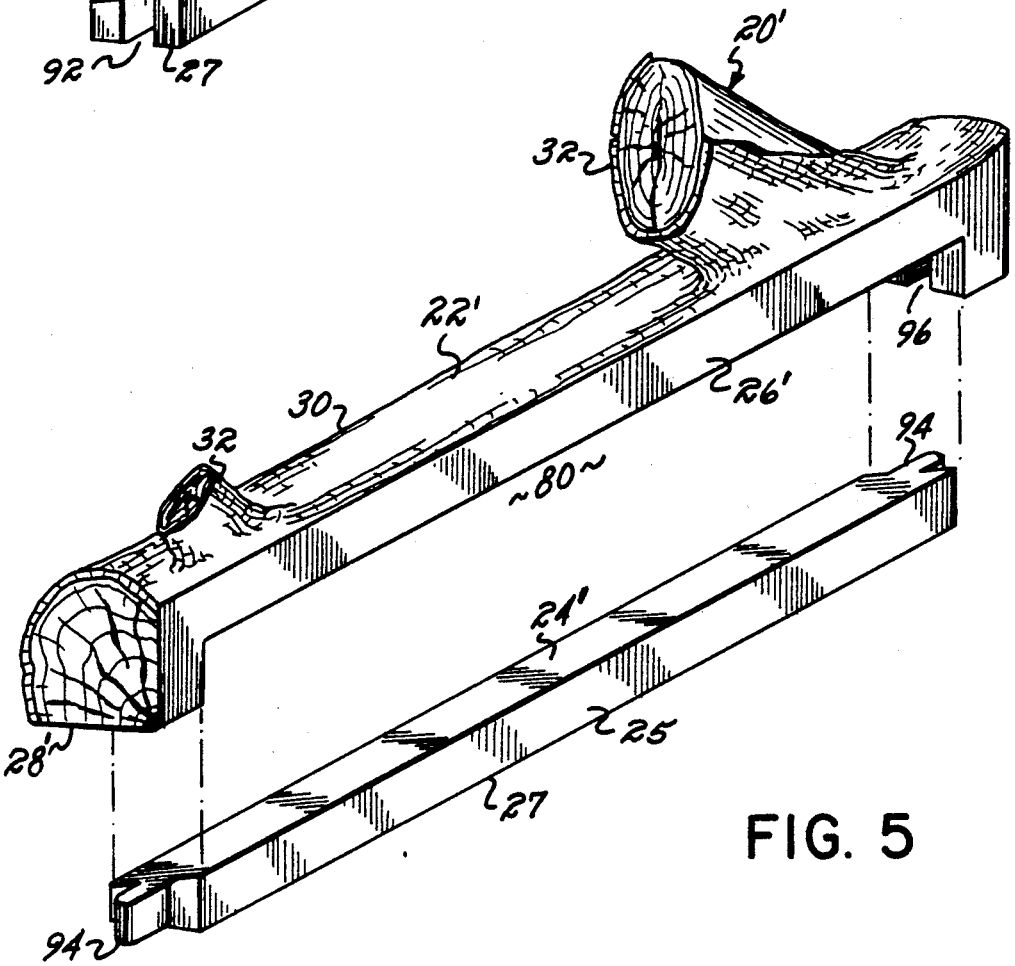
FIG. 5 is an exploded perspective view of an alternative embodiment of the composite log shown in FIG. 3.

FIGS. 3, 4 and 5 show an alternative embodiment of the composite log of the present invention. In this embodiment, composite log 20' has an upper section 22' and a lower section 24', each of which is preferably made of the material disclosed herein with respect to upper and lower sections 22 and 24 of composite log 20, respectively. Upper section 22' has substantially flat rear and bottom surfaces 26' and 28', respectively. In addition, upper section 22' has a cavity 80 therein which confronts rear and bottom surfaces 26' and 28'. Cavity 80 is sized to receive matingly therein (as shown in FIG. 3) lower section 24', while leaving rear and bottom surface portions 25 and 27 of lower section 24' visible when lower section 24' is positioned in cavity 80. Upper section 22' may preferably include projections 90, which project into cavity 80 at opposite ends thereof, and which are adapted to mate with channels 92 in lower section 24' to releasably secure lower section 24' in cavity 80 (FIG. 4). Alternatively, lower section 24' may have projections 94 at opposite ends thereof which are adapted to mate with channels 96 at opposite ends of cavity 80 to releasably secure lower section 24' in cavity 80 (FIG. 5).

It will be appreciated by persons skilled in the art that numerous variations on the composite log of the present invention are possible without departing from the spirit of the invention, the scope of which is defined by the appended claims.

I claim:

1. A composite artificial log for use in gas-fired fireplaces and stove assemblies comprising:

an elongated ceramic concrete section having a surface outwardly exposed in said assemblies, said section molded to provide the appearance of a real log, said section having a cross-section constituting a substantial fraction of the cross-section of the log and a relatively high thermal conductivity for radiating heat to the surroundings when heated; and an elongated ceramic fiber section having at least one surface outwardly exposed in said assemblies, said section secured to said ceramic concrete section and having a cross-section constituting a substantial fraction of the cross-section of the log, said ceramic fiber section having a relatively high thermal conductivity which glows visibly when heated above about 1470° F.

2. A composite artificial log for use in gas-fired fireplaces and stove assemblies comprising:

a solid elongated ceramic concrete upper section having substantially flat bottom and rear surfaces and a convex front surface, at least one of said surfaces being outwardly exposed in said assemblies, said upper section having a relatively high thermal conductivity and molded to provide the appearance of a section of a real log; and a solid elongated ceramic fiber lower section having substantially flat top and bottom surfaces, at least one of said surfaces being outwardly exposed in said assemblies, said upper section and said lower section secured together along their bottom and top surfaces, respectively, said lower section having a relatively low thermal conductivity which glows visibly when heated above about 1470° F.

3. The composite artificial log of claim 2 wherein said upper and lower sections are secured together with an adhesive.

4. A composite artificial log for use in gas-fired fireplaces and stove assemblies comprising:

a solid elongated ceramic concrete upper section having a surface outwardly exposed in said assemblies, said section molded to provide the appearance of a real log, said upper section having a relatively high thermal conductivity for radiating substantial heat to the surroundings when heated; and a solid elongated lower section having at least one surface outwardly exposed in said assemblies, said section secured to and positioned below said upper section consisting essentially of an inorganic alumina silicate fiber and a binder material, said lower section having a relatively low thermal conductivity which glows visibly when heated above about 1470° F.

5. The composite artificial log of claim 4 wherein said binder material is amorphous silica.

6. A composite artificial log for use in gas-fired fireplaces and stove assemblies comprising:

a solid elongated ceramic concrete upper section having a surface outwardly exposed in said assemblies, said section molded to provide the appearance of a real log, said upper section having a thermal conductivity above about 0.5 BTU/hr Ft° F. for radiating heat to the surroundings when heated; and a solid elongated ceramic fiber lower section having at least one surface outwardly exposed in said assemblies, said section secured to and positioned below said upper section, said lower section having a thermal conductivity of approximately 0.09 BTU/hr Ft° F. which glows visibly when heated above about 1470° F.

7. A composite artificial log for use in gas-fired fireplaces and stove assemblies comprising:

an elongated ceramic concrete upper section molded to provide the appearance of a real log, said upper section having rear and bottom surfaces and a convex front surface, at least one of said surfaces being outwardly exposed in said assemblies, said upper section having a cavity therein which confronts said rear and bottom surfaces, said upper section having a relatively high thermal conductivity for radiating heat to the surroundings when heated; and a solid elongated ceramic fiber lower section sized to fit comformingly in said cavity in said upper section, said section having at least one surface outwardly exposed in said assemblies, said lower section having a relatively low thermal conductivity which glows visibly when heated above about 1470° F.

8. A composite artificial log for use in gas-fired fireplaces and stove assemblies comprising:

a first elongated section having a surface outwardly exposed in said assemblies, said section molded to provide the appearance of a real log, said section having a cross-section constituting a substantial fraction of the cross-section of the log and a relatively high thermal conductivity for radiating heat to the surroundings when heated; and a second elongated section having at least one surface outwardly exposed in said assemblies, said section secured to said first section and having a cross-section constituting a substantial fraction of the cross-section of the log, having a relatively low thermal conductivity which glows visibly when heated above about 1470°.

* * * * *